US006192960B1

(12) United States Patent
Simon

(10) Patent No.: US 6,192,960 B1
(45) Date of Patent: Feb. 27, 2001

(54) DEVICE FOR GUIDING A DOOR WITH FLEXIBLE ROLLER SHUTTER

(76) Inventor: Bernard Simon, 20 Chem JB Gailliard, Caluire et Cuire (FR), 69300

( * ) Notice: Subject to any disclaimer, the term of this patent is extended or adjusted under 35 U.S.C. 154(b) by 0 days.

(21) Appl. No.: 09/402,487

(22) PCT Filed: Apr. 16, 1998

(86) PCT No.: PCT/FR98/00763

§ 371 Date: Oct. 14, 1999

§ 102(e) Date: Oct. 14, 1999

(87) PCT Pub. No.: WO98/48139

PCT Pub. Date: Oct. 29, 1998

(30) Foreign Application Priority Data

Apr. 23, 1997 (FR) ..... 97 05305

(51) Int. Cl.[7] ..... A47H 5/032
(52) U.S. Cl. ..... 160/84.06; 160/266
(58) Field of Search ..... 160/84.01, 84.06, 160/270, 271, 272, 266, 274, 278

(56) References Cited

U.S. PATENT DOCUMENTS

| | | | | |
|---|---|---|---|---|
| 422,292 | * | 2/1890 | Chase | 160/277 |
| 449,042 | * | 3/1891 | Haswell | 160/277 |
| 471,114 | * | 3/1892 | Haswell | 160/277 |
| 767,909 | * | 8/1904 | Miller | 160/277 |
| 1,169,803 | * | 2/1916 | Greenberg | 160/277 |
| 1,434,882 | * | 11/1922 | Flagg | 160/277 |
| 1,807,769 | * | 6/1931 | Wileman | 160/277 |
| 2,240,416 | * | 4/1941 | Pidgeon | 160/266 |
| 2,318,525 | * | 5/1943 | Renton | 160/172 R |
| 3,465,806 | * | 9/1969 | Sulkes | 160/84.06 |
| 4,934,437 | * | 6/1990 | Kraeutler | 160/271 |
| 5,141,043 | | 8/1992 | Kraeutler . | |
| 5,183,093 | * | 2/1993 | Kraeutler | 160/84.06 |
| 5,219,015 | | 6/1993 | Kraeutler . | |
| 5,294,931 | * | 3/1994 | Kraeutler | 160/84.01 |
| 5,379,823 | * | 1/1995 | Kraeutler | 160/84.06 |
| 5,937,929 | * | 8/1999 | Chen | 160/84.06 |

FOREIGN PATENT DOCUMENTS

| | | | | |
|---|---|---|---|---|
| 1148049 | * | 5/1963 | (DE) | 160/84.01 |
| 3743366 | | 7/1989 | (DE) . | |
| 0398791 | | 11/1990 | (EP) . | |
| 0688936 | | 12/1995 | (EP) . | |
| 1569966 | * | 6/1969 | (FR) | 160/266 |
| 2545871 | * | 11/1984 | (FR) | 160/84.06 |

* cited by examiner

*Primary Examiner*—Blair M. Johnson
(74) *Attorney, Agent, or Firm*—Greenblum & Bernstein, P.L.C.

(57) ABSTRACT

Guidance device for guiding a flexible curtain in an opening, the guidance device including a first guideway for mounting to a jam of the opening. The first guideway includes at least two straps defining a space therebetween at least one of the two straps being stretched between at least two points on the jam. A second guideway is mounted to another jam of the opening, the second guideway comprising at least two straps defining a space therebetween. At least one of the two straps being stretched between at least two points on the jam, wherein the first and second guideways are adapted to flexibly guide the flexible curtain within the opening.

14 Claims, 8 Drawing Sheets

DEVICE FOR GUIDING A DOOR WITH FLEXIBLE ROLLER SHUTTER

BACKGROUND OF THE INVENTION

1. Field of the Invention

This invention relates to a guidance device for a flexible curtain containing horizontal cross-pieces forming the panel of a motor-driven flexible curtain door, allowing the panel to be moved quickly between a closed position and an open position.

The guidance device in this invention is intended in particular for doors in which the flexible curtain is either rolled around a drum or folded, concertina-style, in a given space.

2. Description of Background and Relevant Information

There are known flexible curtain doors which have two vertical, parallel metal supports in a U or C shape which can be fitted either directly into a concrete frame on which the door is fitted, or via elastic components placed between the vertical jambs of the concrete frame and the metal supports, as described in European patent application No. 92 909384.

Each metal support receives a straight guidance path in which the lateral edges of the flexible curtain run when it is moved between a closed position and an open position.

The guidance paths are made from channel in which a slideway is placed to guide the lateral edges of the curtain in each direction. Each guidance path includes a slideway whose internal profile is roughly square, with one edge having a slot running the full height of the said guidance path for the curtain to pass along.

The guidance paths are made of a semi-elastic material, so that when a pulling force is exerted on the curtain, the lateral edges of the curtain are released from the guidance paths.

This type of flexible curtain door has certain problems in that it is impossible to have access to and to clean the internal walls of the slideways fitted in each guidance path. When these doors are installed in rooms where food products are processed, it is essential to clean the door, and in particular the guidance paths completely after each day's work. The structure of the guidance paths described above means that this procedure is impossible without completely dismantling the door.

In addition, the guidance paths have very low resistance to impact, since the semi-elastic material of which the section is made is weakened by the slot made along its full height.

Slideways are more traditionally made of an open, U-shaped section the width across which is identical from top to bottom, a solution which is unsuitable for the way in which these doors operate.

Thus for concertina-style flexible curtain doors, these slideways have made it necessary to accommodate, when the door is open, a significant volume of stacked slats, while the passage that is necessary and sufficient in the closed position is limited to the thickness of the door.

Similarly, for roll-up doors, the curtain shifts in its vertical plane because of the change in the diameter of the roller curtain, depending on whether it is in the open or closed position. It is therefore recommended that the upper part of the slideway should be wider, to allow the panel to drop without restriction and without friction.

The guidance device in this invention is intended to correct these problems.

SUMMARY OF THE INVENTION

The guidance device in the invention includes, on the vertical and opposite jambs of a flexible curtain door, straps which are arranged opposite each other to form a guideway on each jamb for the horizontal cross-pieces, with the said straps each being stretched and fixed between two end points built into the corresponding jamb to allow each strap, when subjected to an external force, to deform elastically and return undamaged to its original position.

The guidance device in this invention has on each jamb of the door two straps with a sloping part to provide accommodation space for the flexible curtain, and a straight vertical part so that the straps are parallel with each other to guide the said curtain in its vertical movements between a closed position and an open position.

The guidance device in this invention provides each strap has, between a holding pin and a stop, a sloping part to form, with the other strap, a V-shaped space to accommodate the unwinding of the flexible curtain of a roll-up door when it is blocked in its descent by an obstacle.

In the invention, the guidance device provides each strap has, between a holding pin and a stop, a first sloping part, and between the stop and another midway stop a second sloping part to form, with the other strap, a graduated opening space to accommodate the folds of the flexible curtain of a concertina-style door, when it is closed.

In this invention, the guidance device has straps the width of each of which is dependent on that of the flexible curtain of the door.

In the invention, the guidance device has stops against which the straps bear so that the line of each strap is defined along its whole length.

In this invention, the guidance device has, between two straps on a jamb of the door, and especially in the straight vertical part of these, a distance d close to that of the thickness of the flexible curtain.

In this invention, the guidance device has straps, each of which is able, when subjected to an external force, to deform elastically, on the one hand around its vertical axis, and on the other perpendicularly to its vertical axis, and to return undamaged to its original position.

This invention also relates to a flexible curtain door that includes vertical and opposite jambs on which are fixed straps which are arranged opposite each other to form a guideway on each jamb for the horizontal cross-pieces of the flexible curtain, with the said straps each being stretched fixed between two end points, built into the jambs to allow each strap, when subjected to an external force, to deform elastically and return undamaged to its original position.

BRIEF DESCRIPTION OF THE DRAWINGS

The following description, referring to the attached drawings which are given as non-restrictive examples, will enable a better understanding of the invention, its characteristics and the advantages it can provide.

DETAILED DESCRIPTION OF THE INVENTION

Figure 1:
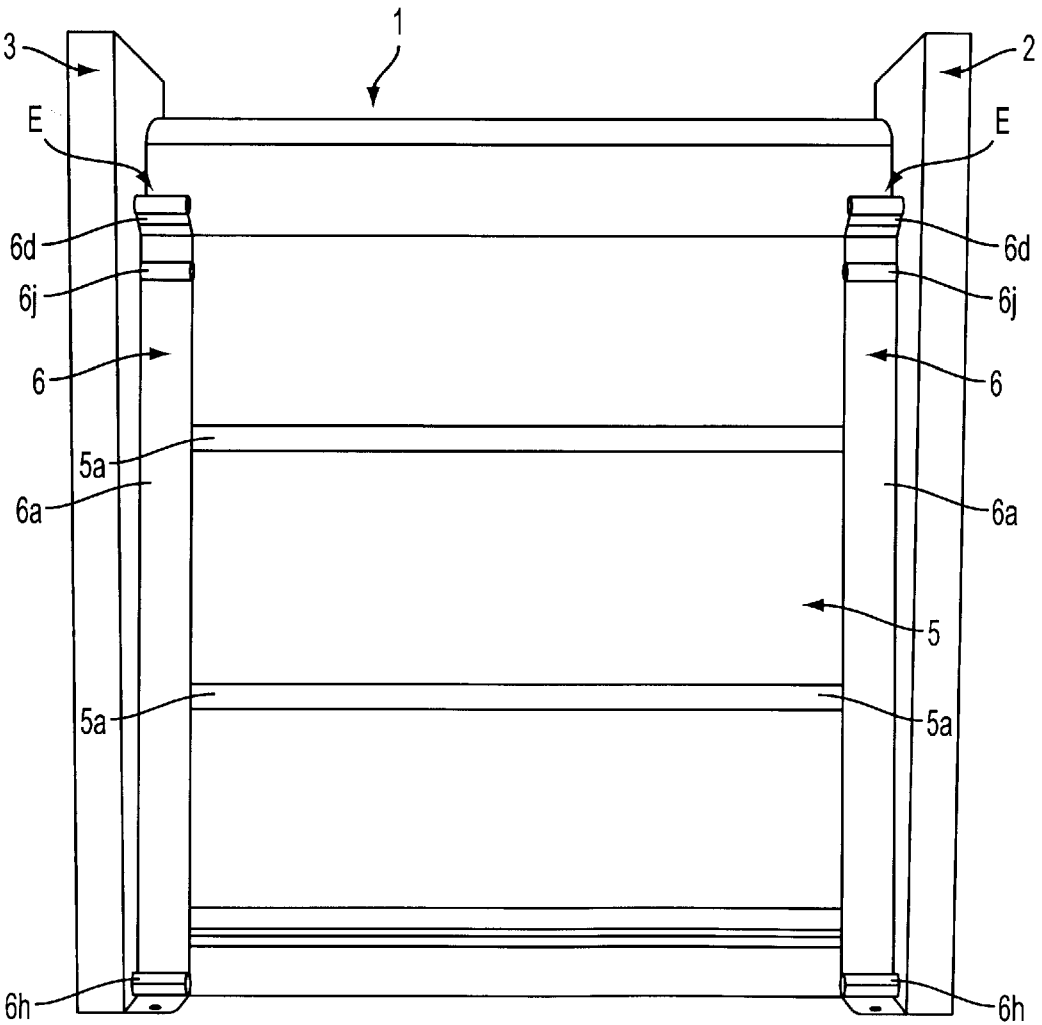
FIG. 1 is a front view showing a flexible roll-up curtain door according to this invention.
Figure 2:
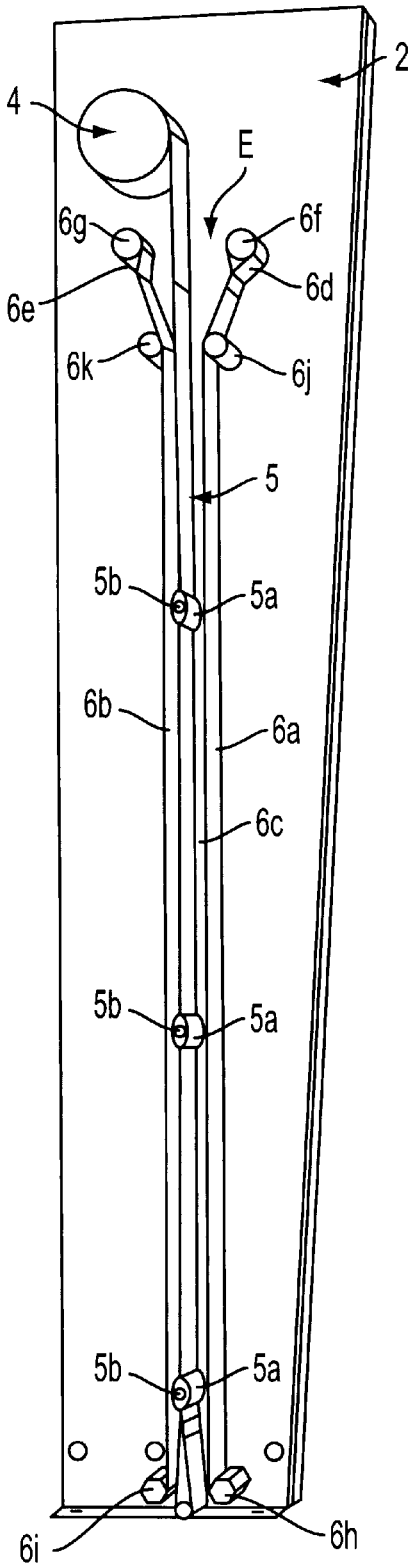
FIG. 2 is a perspective view showing a vertical jamb of the door in FIG. 1, fitted with the guidance device according to this invention.

FIGS. 1 and 2 show a door 1 comprising two lateral jambs 2 and 3 which are normally fixed against the vertical walls of an opening to be closed off. The opposite and vertical jambs 2 and 3 are linked together at the top by a roller drum 4 for a flexible curtain 5.

The jambs 2 and 3 have an integral guidance device 6 for the flexible curtain 5 for its movements between a closed position and an open position.

It will be observed that the flexible curtain has sleeves 5*a* in which the horizontal reinforcing cross-pieces 5*b* are inserted, their ends engaging in the guidance devices 6 fitted on each jamb 2 and 3 (FIG. 2).

Each guidance device 6 has two straps 6*a* and 6*b* fitted one opposite the other to provide on each jamb 2 and 3 a guideway 6*c* for the curtain 5 and its cross-pieces 5*b*.

For the sake of clarity and understanding, only the guidance device 6 on jamb 2 will be described, since the other fitted on jamb 3 is identical.

The straps 6*a* and 6*b* of the guidance device 6 each have at one end a loop 6*d*, 6*e* each of which fits onto an end point formed by a holding pin 6*f*, 6*g* built into the jamb 2. Holding pins 6*f* and 6*g* are arranged one opposite the other and close to the drum 4 holding the curtain 5 of the door 1.

At the bottom of jamb 2 there are two tensioners 6*h* and 6*i* forming the other ends of the guidance device which respectively hold the opposite ends to the ends with the loops 6*f* and 6*g* of the straps 6*a* and 6*b*. The tensioners 6*h* and 6*i* are both placed at the same level, and show, for example, a six-sided outside profile so that a spanner can be used to stretch each strap 6*a* and 6*b* between the two end points formed by the pins 6*f*, 6*g* and the tensioners 6*h*, 6*i*.

There are two opposite stops 6*j* and 6*k* between the two end points of the guidance device 6, against which the straps 6*a* and 6*b*, respectively, bear.

Stops 6*j* and 6*k* are arranged on the one hand, offset with respect to pins 6*f* and 6*g* and on the other, on the same vertical axis as the tensioners 6*h* and 6*i*. This configuration allows the straps 6*a* and 6*b* to include a sloping part to provide accommodation space E for the flexible curtain 5 near the drum 4, whose function will be seen later.

Straps 6*a* and 6*b* have, in the extension of the accommodation space E a straight vertical part so that the said straps are parallel with each other to guide the flexible curtain 5 in its vertical movements between a closed position and an open position.

Thus each strap 6*a* and 6*b* has a sloping part between the respective pins 6*f*,6*g* and the stops 6*d*, 6*k* to form space E which is more particularly V-shaped.

Figure 3:
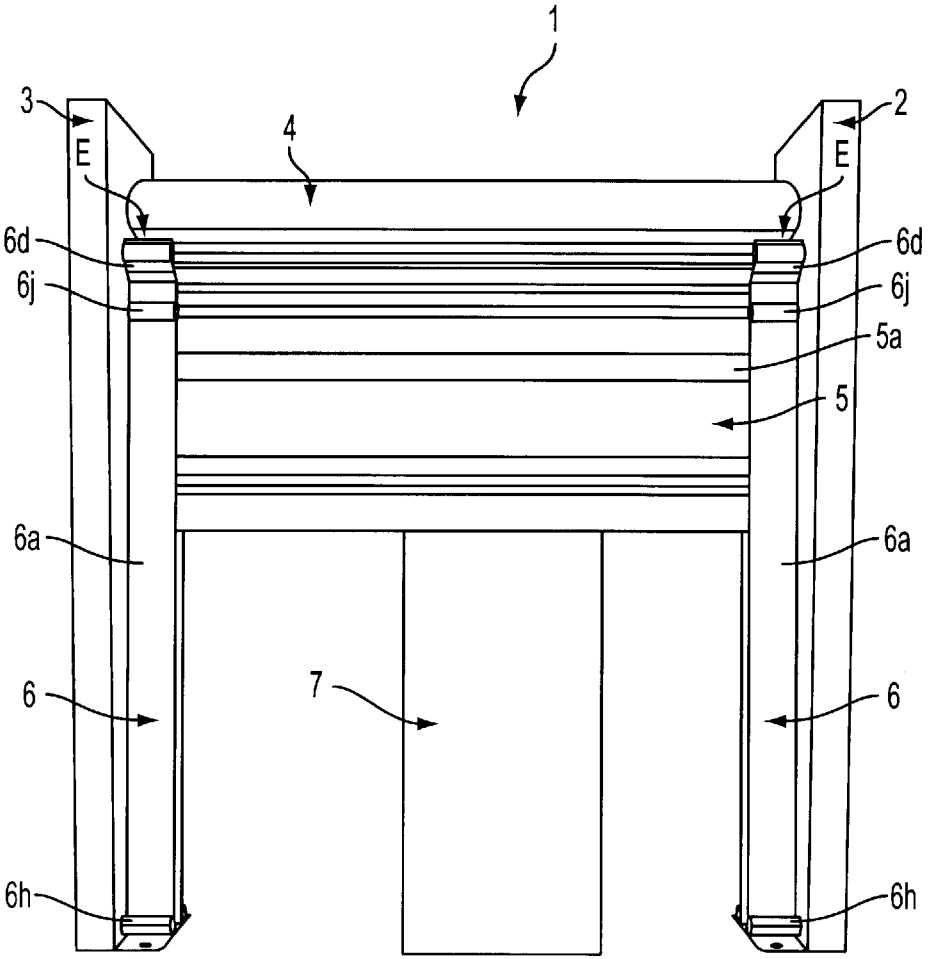
FIG. 3 is a view similar to that of FIG. 1, but showing the flexible curtain of the door hindered in its movements by an obstacle.
Figure 4:
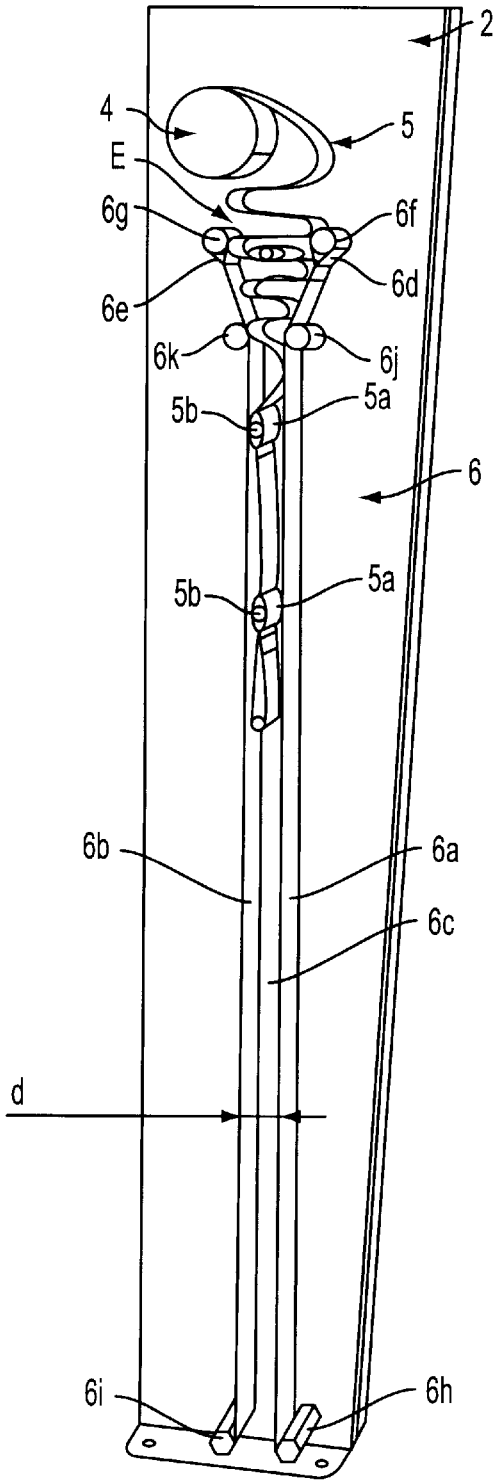
FIG. 4 is a view similar to that of FIG. 2, but showing the unwinding of the flexible curtain at the upper end of the guidance device according to the invention, when the said curtain is blocked in its descent by an obstacle.

FIGS. 3 and 4 show the flexible curtain 5 of the roll-up door 1 which is blocked in its descent by an obstacle 7. Under these conditions the curtain 5 continues to unwind and is accommodated in space E of the guidance device 6. It is then only necessary to reverse the rotation of the drum 4 to roll the curtain 5 up again.

Figure 5:
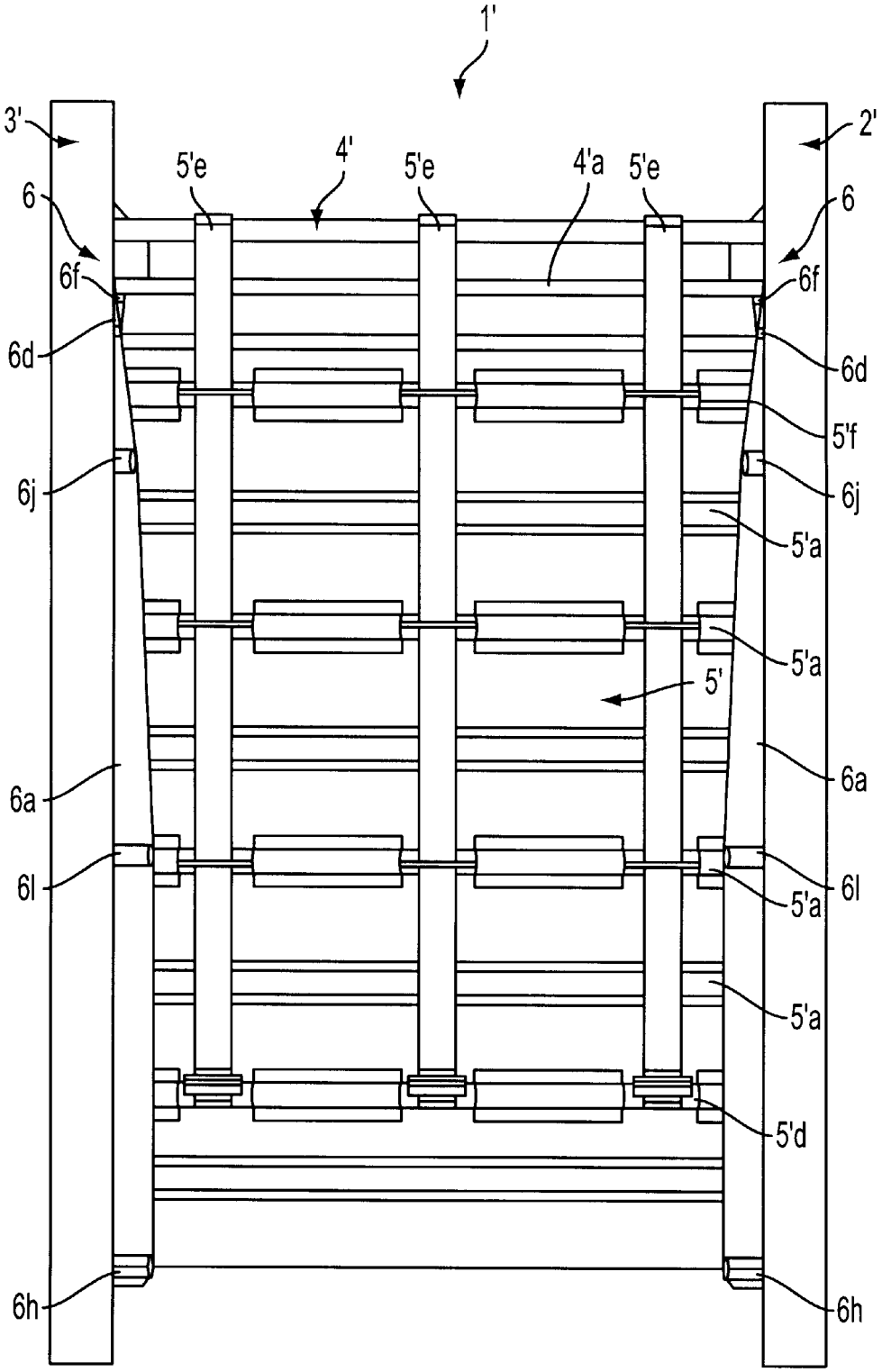
FIG. 5 is a front view showing a flexible concertina-style curtain door, according to this invention, in the closed position.
Figure 6:
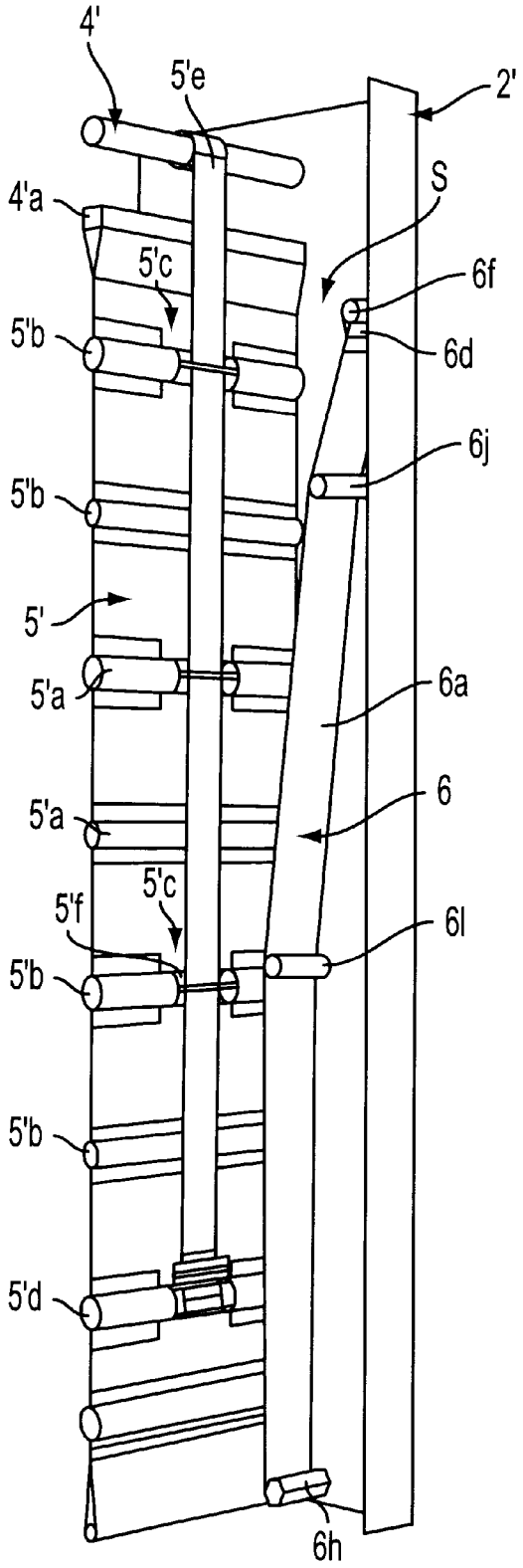
FIG. 6 is a perspective view showing a jamb of the door in FIG. 5, fitted with the guidance device according to the invention in the closed position.
Figure 8:
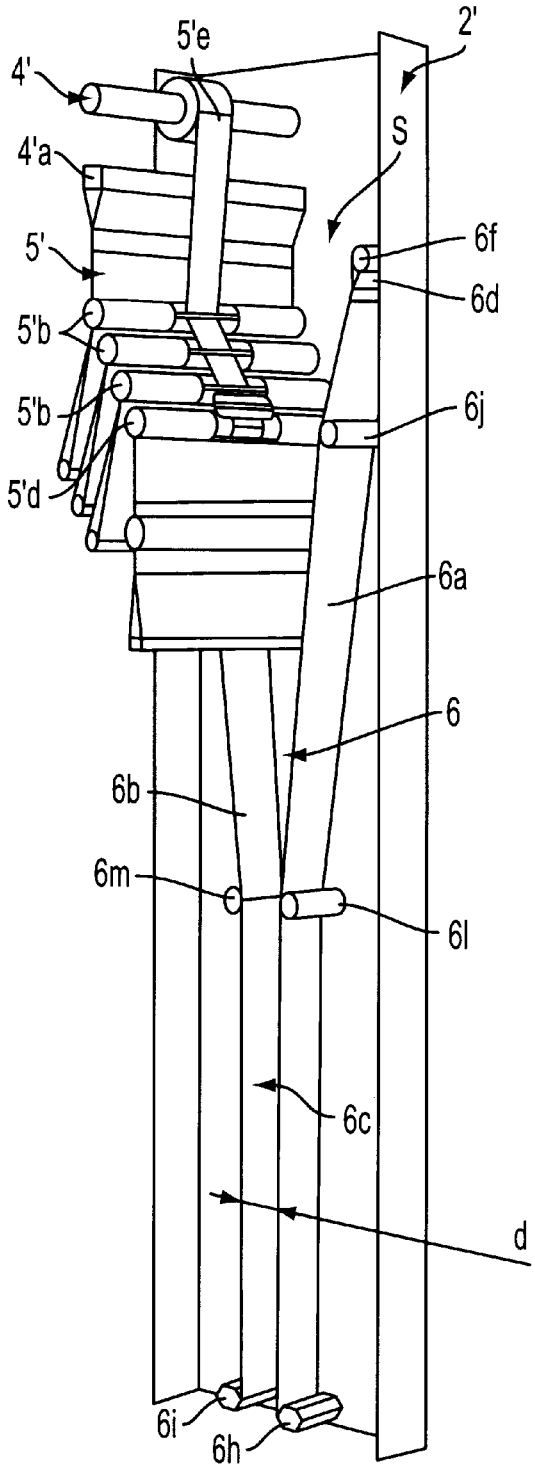
FIG. 8 is a perspective view showing one of the jambs of the door in FIG. 7, fitted with the guidance device according to the invention in the open position.

FIGS. 5 and 8 show a concertina-style door 1' with two lateral jambs 2' and 3' which are fixed against the vertical walls of an opening to be closed off.

The opposite and vertical jambs 2' and 3' are linked together at the top of the door 1' by a winding drum 4' and a transverse fixed bar 4'*a* on which is held a flexible curtain 5'.

Jambs 2' and 3' are integral with a guidance device 6 similar to that described above for the roll-up door 1. The guidance device 6 has a slideway 6*c* for guiding the flexible curtain 5' when it moves between a closed position and an open position.

The flexible curtain 5' has sleeves 5'*a* with openings 5'*c* for passage of horizontal reinforcing cross-pieces 5'*b*. The flexible curtain 5' has another horizontal cross-piece 5'*d* at the bottom which is linked by pulling straps 5'*e* to the winding drum 4'. The straps 5'*e* are guided at each horizontal reinforcing cross-piece 5'*b* via strap carriers 5'*f* arranged in the openings 5'*c* of the sleeves 5'*a*. Sleeves 5'*a* without openings are also provided, in which other reinforcing cross-pieces 5'*b* are inserted.

The drive system for the curtain 5' described above allows it to fold up, as it is opened in the upper part of the door 1'.

For the sake of clarity and understanding, only the guidance device 6 on jamb 2' will be described, since the other fitted on jamb 3' is identical. Moreover it is mainly the new and additional parts of the guidance device 6 not used in the roll-up door 1 which will be described here.

Thus the straps 6*a* and 6*b* with their loops 6*b* and 6*c* are fixed and stretched between two end points built into the jamb 2', that is between the pins 6*f*, 6*g* and the tensioners 6*h*, 6*i*.

Each strap 6*a* and 6*b* is supported between the pins 6*f*, 6*g* and the tensioners 6*h*,6*i* on a first upper stop 6*j*, 6*k* and on a second midway stop 6*1*, 6*m*.

The straps 6*a*, 6*b* include between pins 6*f*, 6*g* and stops 6*j*, 6*k* an initial slope which is extended by a second slope at a different angle between stops 6*j*, 6*k* and midway stops 6*1*, 6*m*.

Figure 7:
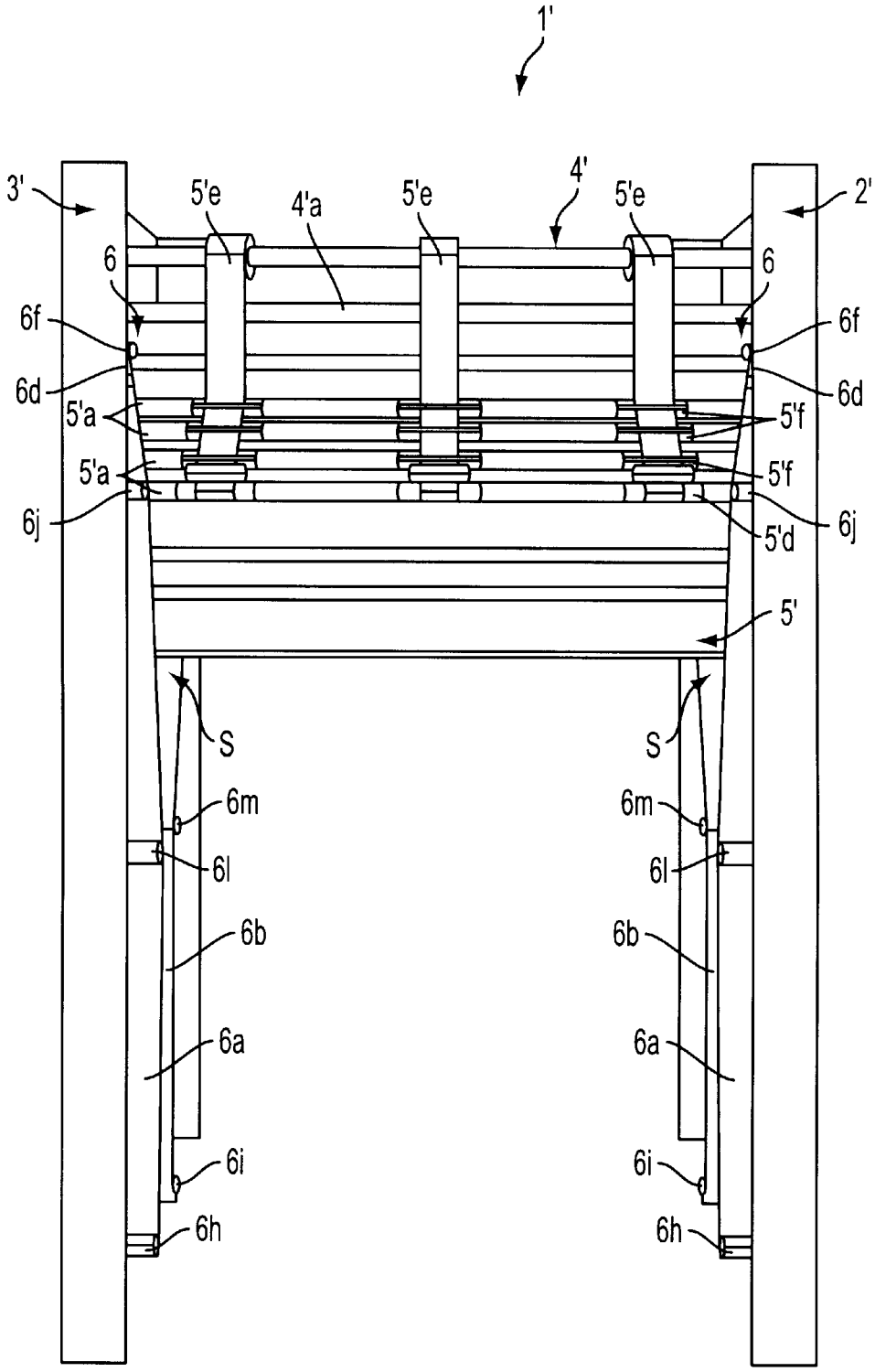
FIG. 7 is a front view showing the door in FIG. 5 in the open position.

This configuration allows the straps 6*a* and 6*b* to mark out a graduated opening space S to take the folds of the flexible curtain 5' as it opens (FIGS. 7 and 8).

The straps 6*a* and 6*b* have, in the extension of the space S, a straight vertical part so that the said straps are parallel with each other to guide the flexible curtain 5' in its movements.

It will be noted that the guidance devices 6 built into the jambs 2, 2' and 3, 3' of the doors 1, 1' are accessible without being dismantled and are easy to clean when the doors are intended for use in a food handling environment.

In addition, the guidance devices 6 fitted on the doors 1 and 1' have straps 6*a* and 6*b* whose width depends on that of curtain 5, 5' to be moved.

The guidance devices 6 have, between two straps 6*a*, 6*b* on one jamb of the door, and especially in the straight vertical part of these, a distance d close to that of the thickness of the flexible curtain 5, 5'.

It will be observed that the guidance devices 6 have straps 6*a*, 6*b*, each of which is able, when subjected to external force, to deform elastically, on the one hand around its vertical axis and on the other perpendicularly to its vertical axis, and to return undamaged to its original position.

This is because the relative elastic deformation of the straps 6*a*, 6*b* when the flexible curtain 5, 5' is blocked, or a lateral impact occurs, allows the horizontal cross-pieces to move out of position without risk of damage to the cross-pieces or to the straps.

In addition, the guidance device 6 reduces operating noise since there is no metal-to-metal contact, such as occurs on other doors.

What is claimed is:

1. A guidance device guiding a flexible curtain in a door opening wherein the flexible curtain comprises a plurality of horizontal cross-piece, the guidance device comprising:

a first guideway mounted to a first vertical jamb of the door opening, the first guideway comprising at least two straps defining a space therebetween, each of the at least two straps being stretched between at least two points on the first vertical jamb, the at least two straps being elastically deformable;

a second guideway mounted to a second vertical jamb of the door opening, the second guideway comprising at least two straps defining a space therebetween, each of the at least two straps being stretched between at least two points on the second vertical jamb, the at least two straps being elastically deformable;

wherein the first and second guideways flexibly guide the flexible curtain within the space of the at least two straps within the door opening.

2. The guidance device of claim 1, wherein the first and second guideways guide a side portion of the flexible curtain.

3. The guidance device of claim 1, wherein the at least two straps of the first and second guideways are at least partially arranged on each of the first and second vertical jambs with an accommodation space and a parallel guide space, the accommodation space having a width which is greater than a width of the parallel guide space.

4. The guidance device of claim 3, wherein the accommodation space comprises a V-shaped space for accommodating a rolling up of some portion of the flexible curtain when the flexible curtain is unwound.

5. The guidance device of claim 1, wherein each of the at least two straps of the first and second guideways comprises top and bottom ends, the top ends each being connected to a top portion of the corresponding first and second vertical jambs via a holding pin.

6. The guidance device of claim 5, further comprising at least two stops disposed on the first and second vertical jambs for deflecting each of the at least two straps towards one another.

7. The guidance device of claim 6, wherein the at least two straps are deflected by the stops so as to form a V-shaped accommodation space.

8. The guidance device of claim 7, wherein the space in the first and second guideways comprises a width which is sufficient to allow the flexible curtain to travel within.

9. The guidance device of claim 1, further comprising at least one tensioning device for stretching at least one of the at least two straps on one of the first and second vertical jambs.

10. The guidance device of claim 9, further comprising at least one loop disposed on an end of at least one strap for securing the end of the strap to one of the first and second vertical jambs.

11. The guidance device of claim 1, wherein the flexible curtain comprises concetina-style door.

12. The guidance device of claim 1, wherein the flexible curtain includes a motorized drum for rolling and unrolling the flexible curtain.

13. A flexible curtain door comprising:

a first vertical jamb;

a second vertical jamb disposed substantially parallel to the vertical first jam, the first and second vertical jambs defining a door opening;

a first guideway disposed on the first vertical jamb, the first guideway comprising at least two elastically deformable straps, each one of the at least two straps being stretched between at least two points on the first vertical jamb;

a second guideway disposed on the second vertical jamb, the second guideway comprising at least two elastically deformable straps, each one of the at least two straps being stretched between at least two points on the second vertical jamb; and a flexible curtain which is moveable within the door opening, the flexible curtain comprising a plurality of horizontal cross-pieces, wherein the first and second guideways flexibly guide the flexible curtain within the opening.

14. A flexible curtain door utilizing a guidance device for guiding a motorized flexible curtain in an opening, the flexible curtain door comprising:

a first guideway for mounting to a first vertical jamb of the opening, the first guideway comprising at least two elastically deformable straps defining a space therebetween, each of the at least two straps being stretched between at least two points on the first vertical jamb;

a second guideway for mounting to a second vertical jamb of the opening, the second guideway comprising at least two elastically deformable straps defining a space therebetween, each of the at least two straps being stretched between at least two points on the second vertical jamb; and a motorized device for moving the flexible curtain within the opening, wherein the first and second guideways are each adapted to flexibly guide an end portion of the flexible curtain within the opening.

* * * * *